US009010260B1

(12) United States Patent
Chen

(10) Patent No.: US 9,010,260 B1
(45) Date of Patent: Apr. 21, 2015

(54) PADDLE OR POLE SHAFT SAIL DEVICE

(71) Applicant: Shane Chen, Camas, WA (US)

(72) Inventor: Shane Chen, Camas, WA (US)

( * ) Notice: Subject to any disclaimer, the term of this patent is extended or adjusted under 35 U.S.C. 154(b) by 0 days.

(21) Appl. No.: 14/298,907

(22) Filed: Jun. 7, 2014

Related U.S. Application Data

(63) Continuation-in-part of application No. 13/523,882, filed on Jun. 14, 2012, now abandoned.

(51) Int. Cl.
*B63B 35/00* (2006.01)
*B63B 35/79* (2006.01)

(52) U.S. Cl.
CPC ..... *B63B 35/7953* (2013.01); *B63B 2035/7956* (2013.01)

(58) Field of Classification Search
CPC .. B63B 7/085; B63B 35/7959; B63B 35/7973
USPC ..... 114/39.22, 102.1, 102.11, 108, 39.12
See application file for complete search history.

(56) References Cited

U.S. PATENT DOCUMENTS

| | | | | |
|---|---|---|---|---|
| 2,891,260 | A * | 6/1959 | Wright | 114/345 |
| 3,793,973 | A * | 2/1974 | Patterson | 114/39.24 |
| 4,926,772 | A * | 5/1990 | Bright | 114/39.12 |
| 5,197,401 | A * | 3/1993 | Finley et al. | 114/102.16 |
| 5,377,607 | A * | 1/1995 | Ross | 114/39.12 |
| 6,131,532 | A * | 10/2000 | Winner et al. | 114/345 |
| 6,807,919 | B1 * | 10/2004 | Thomsen | 114/39.12 |
| 6,986,318 | B2 * | 1/2006 | Sawyer | 114/102.1 |
| 7,752,987 | B2 * | 7/2010 | Wiltz | 114/102.11 |
| 8,069,801 | B2 * | 12/2011 | Ott et al. | 114/102.29 |
| 2002/0124782 | A1 * | 9/2002 | Starbuck | 114/39.21 |
| 2012/0318183 | A1 * | 12/2012 | Chen | 114/39.22 |
| 2013/0340661 | A1 * | 12/2013 | Siverts et al. | 114/39.12 |

* cited by examiner

*Primary Examiner* — Lars A Olson
*Assistant Examiner* — Jovon Hayes

(57) ABSTRACT

A shaft mount sail device that may have a sail made of a lightweight, flexible material that is capable of being tightly wound about the shaft of a paddle, push-pole or other shaft, a mechanism for attaching the sail to the shaft, and a clamping member coupled to the sail and configured to releasably clamp onto the shaft. The sail may be rolled tightly about the shaft and the clamping member fit over the shaft to secure the sail in the stowed position. The clamping member in the stowed position may serve as the handle by which a user grasps and operates the shaft. Various embodiments are disclosed.

20 Claims, 5 Drawing Sheets

PADDLE OR POLE SHAFT SAIL DEVICE

CROSS REFERENCE TO RELATED APPLICATIONS

This application is a continuation-in-part of U.S. patent application Ser. No. 13/523,882, filed Jun. 14, 2012, entitled Paddle with Attached Sail for Propelling Watercraft by the inventor above. application Ser. No. 13/523,882 claims the benefit of provisional patent applications Nos. 61/497,191, filed on Jun. 14, 2011, 61/533,219, filed on Sep. 10, 2011, and 61/560,362, on Nov. 16, 2011, all by the present inventor.

FIELD OF THE INVENTION

The present invention relates to sails that may be used in conjunction with a paddle or pole shaft and, more specifically, to such sails that are lightweight, conveniently stowed and relatively simply to use.

BACKGROUND OF THE INVENTION

Paddle-powered watercraft such as kayaks and stand-up paddle boards have long been used for water transportation and recreation. The prior art includes sail devices that can be attached to these watercraft and/or to their paddles for propulsion by wind, when conditions are favorable, in addition to propulsion by conventional paddling.

One prior art arrangement is disclosed in U.S. Pat. No. 6,986,318, issued to Sawyer, and entitled Sail Assembly. This patent is representative of disadvantageous aspects of prior art sail devices. These disadvantageous aspects may include that the devices:

- are bulky;
- have multiple movable parts and/or fastener components;
- are heavy when wet, particularly the canvas or fabric sails;
- are problematic to stow when not in use; and
- interfere with proper and convenient use of the paddle in the stowed position (see for example FIGS. 5-6 of Sawyer, i.e., ready and comfortable use of the paddle is obstructed by the stowed sail).

A need thus exists for a roll out sail for use with a longitudinal paddle or pole shaft that is (1) thin and streamline; (2) exceptionally light weight; (3) made of substantially non-water absorbing material; (4) has no or minimal moving parts and/or components; (5) when stowed, does not interfere with use of the paddle or pole shaft; and/or (6) is stowable in a manner that it becomes the hand-hold for the shaft (and thus may appear to the use as the actual shaft, without closer inspection).

Another disadvantageous aspect of prior art paddle sail devices is that they are effective only for downwind travel. There is a need for a sail and/or paddle and sail arrangement that has effective cross-wind and upwind capabilities.

There is also a need to provide wind propulsion to any mode of manual transportation—kayaking, pole-push skateboarding, etc.—that utilizes a propulsion device having a shaft or similar structure on which a sail may be compactly stowed.

SUMMARY OF THE INVENTION

Accordingly, it is an object of the present invention to provide a shaft-mounted sail device that overcomes the disadvantageous aspect of the prior art.

It is another object of the present invention to provide a shaft-mounted sail device that is light-weight, conveniently stowed when not in use, and/or has few moving parts or components.

It is yet another object of the present invention to provide a shaft-mounted sail device that has a clamping member that clamps around the shaft in the stowed position, thereby functioning as the handhold to operate the shaft and achieving sail stowage in a highly efficient and largely non-visible manner.

It is also an object of the present invention to provide a shaft-mounted sail device that maybe used to propel a watercraft cross-wind or upward without experiencing excessive downwind drift.

These and related objects of the present invention are achieved by use of a paddle or pole shaft sail device as described herein.

The attainment of the foregoing and related advantages and features of the invention should be more readily apparent to those skilled in the art, after review of the following more detailed description of the invention taken together with the drawings.

DETAILED DESCRIPTION

Figure 1:
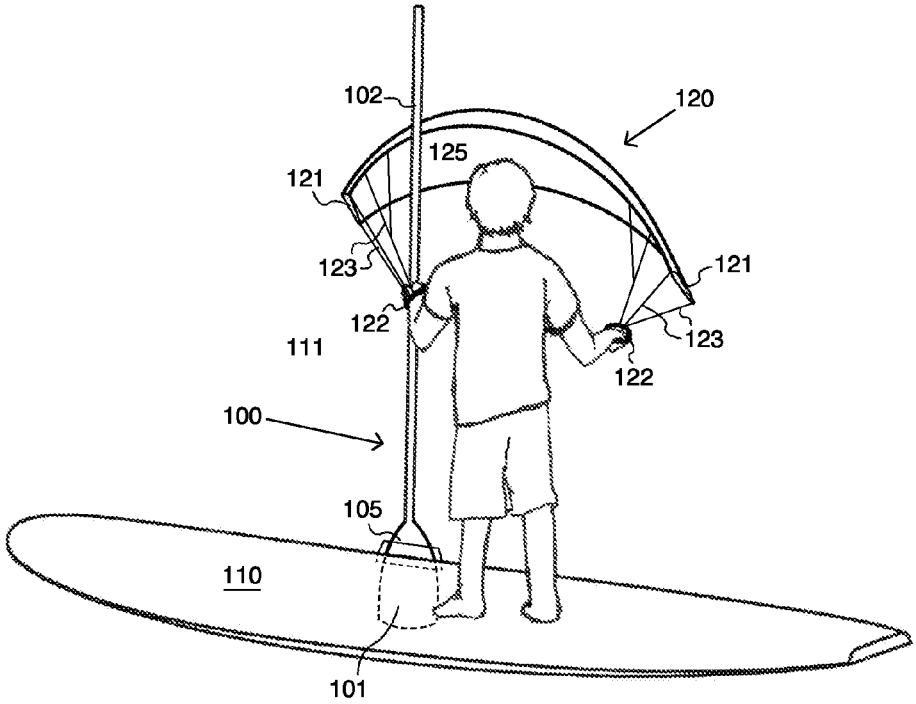
FIG. 1 is a perspective view of a person standing on a watercraft (a paddleboard) and using a paddle and sail device to propel the watercraft by wind power.

Referring to FIG. 1, a perspective view of a person standing on a watercraft (a paddleboard) 110 and using a paddle and sail device 120 to propel the watercraft by wind power is shown.

Paddle 100 has a blade 101 and a shaft 102. A sail 125 may be attached to shaft 102. Sale 120 has a leading (windward) edge and a trailing (leeward) edge, and two ends 121. A bridle 123 attaches each end 121 to a user strap or handle 122 which permits a user to grasp and control the sail device (or attach it to the paddle). The weight of the user anchors sail device 120, and the user can manipulate sail 125 by means of straps 122 in order to control the magnitude and direction of propelling force. Through maneuvering of sail 125, wind power can be used to drive watercraft 110 at various angles relative to the wind direction.

During normal use, the force of the wind holds sail 125 in a curved (arced or bowed) shape. Sail device 120 is constructed such that it may be folded, rolled, crumpled or otherwise collapsed when not in use. Means may be provided for stowing sail device 120 in its collapsed state and securing it to paddle 100, such as with a bag or with ties. With sail device 120 stowed, paddle 100 can be used to propel watercraft 110 by conventional paddling.

The method of operation of paddle 100 and sail device 120 involves holding paddle 100 generally upright against the side of watercraft 110 (as shown in FIG. 1), with the paddle's blade 101 at least partially submerged in the water. Blade 101 can be angled such that the sideways resistance created by the wide face of blade 101 reduces downwind drifting. When blade 101 is submerged in the water, it can furthermore be used to assist in steering watercraft 110. The user can adjust the angle of blade 101 in order to create a rudder effect. A mechanism or member may be provided for resisting slippage between paddle 100 and the edge of watercraft 110. One example of such a mechanism is a rubber cuff 105 attachable to paddle 100. The user may hold paddle shaft 102 with one or both hands while operating sail 120. After a tack or jibe the user may switch the positions of his left and right hands.

Figure 2:
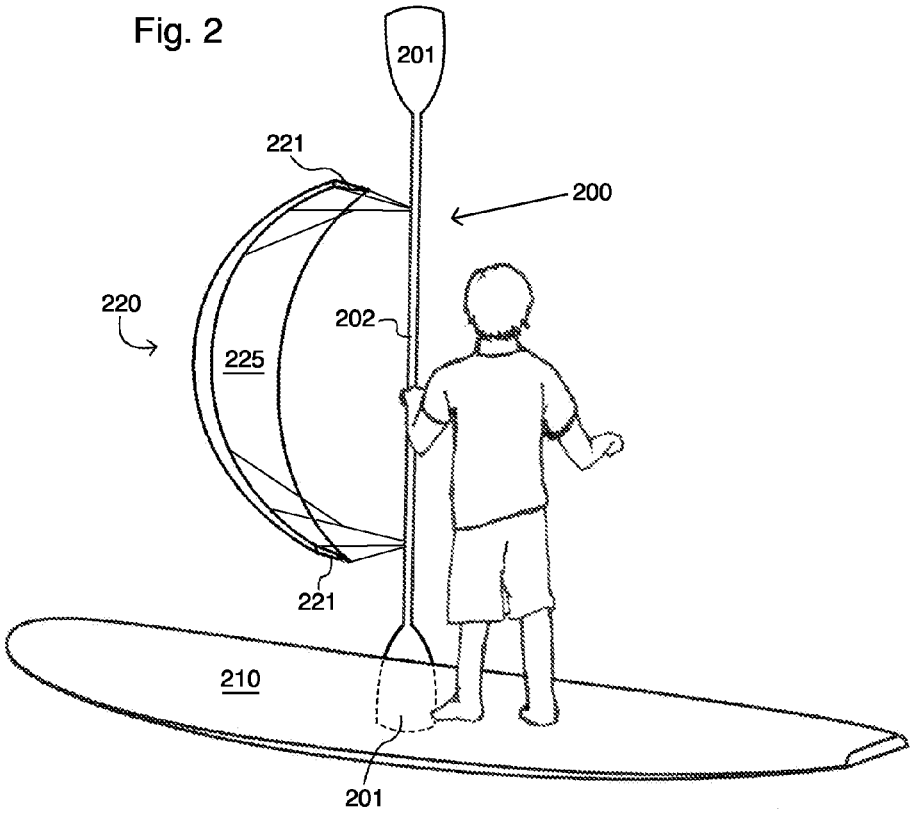
FIG. 2 is a view of a paddleboard and paddle similar to that of FIG. 1, yet having two blades instead of a single blade.

Referring to FIG. 2, a paddleboard 210 and paddle 200 similar to that of FIG. 1, yet having two blades 201 instead of a single blade, is shown. Sail device 220 is also similar to that of FIG. 1, but its two ends 221 are attached to the shaft 202 instead of to the user's hands. The user controls sail device 220 by manipulating shaft 202.

Figure 3:
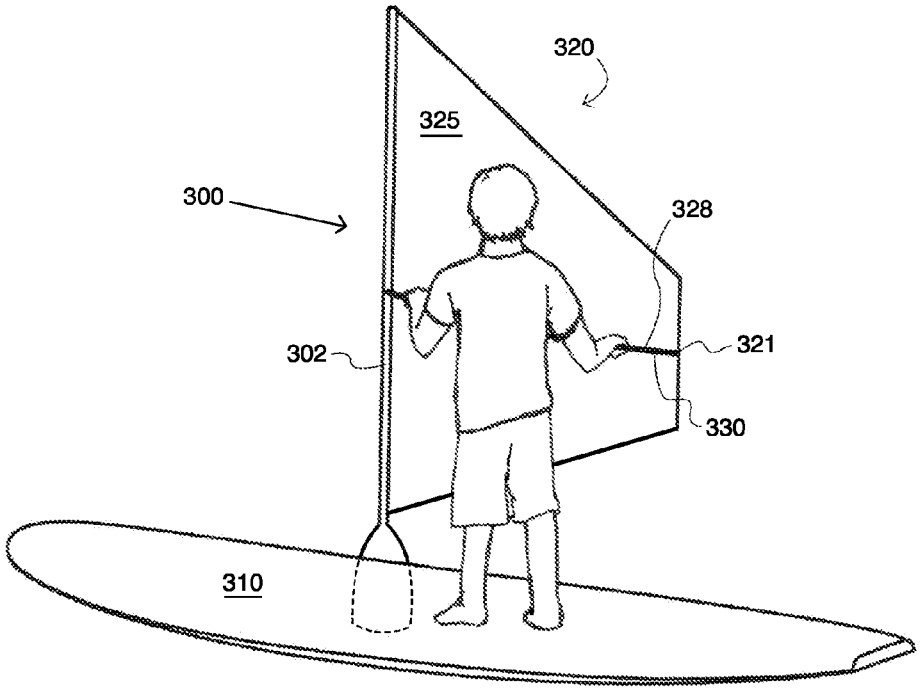
FIG. 3 is another embodiment of a paddle, paddleboard 310 and sail device arrangement.

Referring to FIG. 3, another embodiment of a paddle 300, paddleboard 310 and sail device 320 arrangement is shown. Sail 325 is attached to shaft 302 of paddle 300 such that paddle 300 can function as a mast for sail 325. Sail 325 may be held up by a generally horizontally disposed rod or similar structure 328 (which acts as a boom) and is preferably attached between paddle shaft 302 and sail edge 321. Sail 325 can be rolled around the exterior of shaft 302 (similar to sail 425 below) and clamped around the paddle shaft with a clamping member 330, like clamping member 430 of FIG. 4. The clamping member 330 also forms a "support frame" at edge 321 that in conjunction with boom 328 and paddle shaft 302 supports the sail. Boom 328 may be formed similarly to clamping members 330,430 yet of sufficient dimensions to fit over clamping member 330 when it is mounted to shaft 302.

Figure 5:
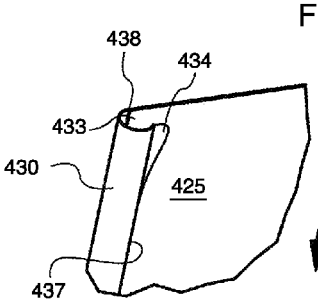
FIG. 5 illustrates greater detail of the clamping member of FIGS. 4 and 6.
Figure 4:
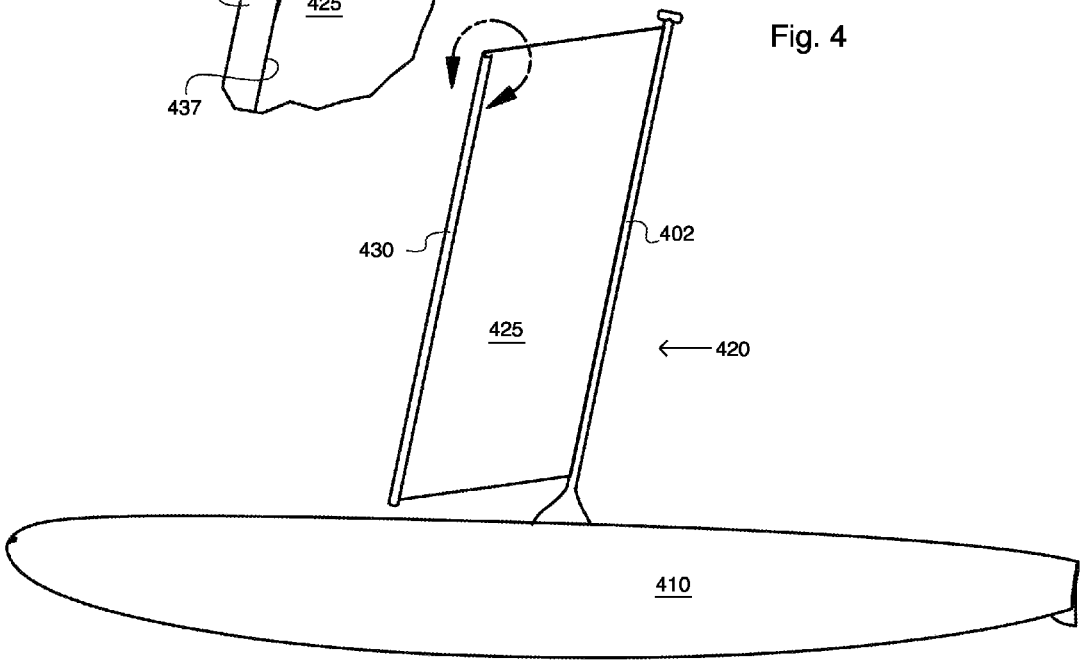
FIG. 4 is a perspective view of a paddle or pole shaft sail device in an unfurled or partially unfurled position in accordance with the present invention.
Figure 6:
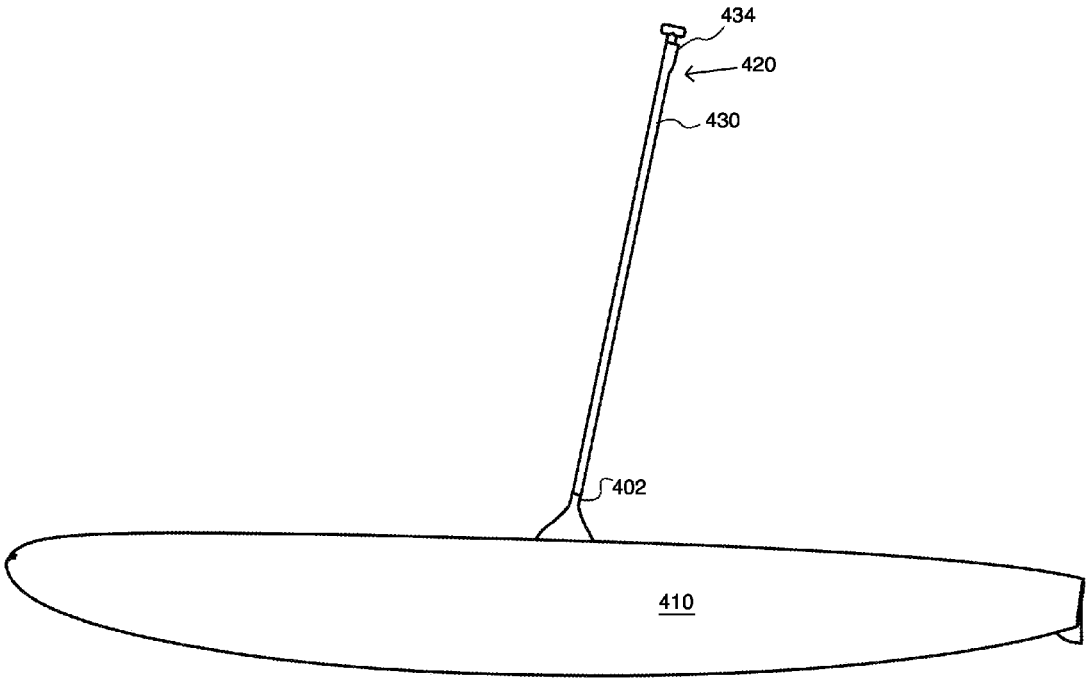
FIG. 6 illustrates paddle or pole shaft device in the stowed position.

Referring to FIG. 4, a perspective view of a paddle or pole shaft sail device 420 in an unfurled or partially unfurled position in accordance with the present invention is shown. FIG. 5 illustrates greater detail of clamping member 430. FIG. 6 illustrates paddle or pole shaft device 420 in the stowed position. Note that the paddle or pole shaft sail device 420 may generally be referred to as "sail device 420" herein.

Sail device 420 may have a rectangular, trapezoidal or other shaped sail 425. Sail 425 is preferably made of a thin, flexible material as discussed in more detail below. When not in use, sail 425 is preferably wound around shaft 402 and secured in this stowed position with longitudinal clamp member or structure 430 (see FIG. 6). Clamp member 430 provides the multiple functions of:

(1) securing the sail in the stowed position around a shaft;

(2) serving as the hand surface (handle) held by a user when conventionally paddling (it snugly fits around the shaft and may appear to the user as the actual shaft, without closer inspection, again see FIG. 6);

(3) being a substantially rigid handhold for the user to grasp the free end of sail 425 when unfurled (see FIG. 4); and (4) acting as a frame to support the sail 425 so that it holds a desired shape when unfurled and subjected to wind.

FIG. 4 illustrates the longitudinal clamp member 430 affixed to the distal (non-shaft) end of sail 425. Clamp member 430 may be made of a hard but slightly flexible material (there are known suitable plastics with these features), and is curved about an axis with a radius comparable to that of shaft 402. FIG. 5 shows details of the top end of clamping member 430 (and a portion of sail 425), showing its curved or partially cylindrical shape which approximates that of the shaft. When sail device 420 is rolled around shaft 402, clamp member 430 fits around the shaft and is held in place. In addition to securing sail 425, clamping member 430 also provides a firm surface to grasp while using the paddle for conventional paddling.

FIG. 5 illustrates a partially cylindrical shape of clamping member 430. Clamping member may have a shape that is 51-100%, circumferentially, of a cylinder. 51% is a minimum to secure to a shaft and 100% is very secure, yet may be more difficult to take off. A shape that is 55-85%, circumferentially, of a cylinder is suitable as is a shape that is 60-80%, circumferentially, of a cylinder.

An opening 433 is defined between the respective longitudinal edges 437,438 of clamping member 430. A tab or protrusion 434 may be provided at one or more ends or along the length of edge 437 to assist in peeling open opening 433 to mount clamping member 430 to a paddle shaft or remove it from one. The exterior surface of clamping member 430 may also have protrusion or a textured surface or the like to assist in being grasped by a user.

Sail 425 is preferably made of BoPET (Biaxially-oriented polyethylene terephthalate) which is a polyester film made from stretched polyethylene terephthalate (PET) and used for its high tensile strength, chemical and dimensional stability, transparency, reflectivity, and gas and aroma barrier properties, etc. A variety of companies manufacture BoPET and related polyester films under different brand names. In the US and UK, the most well-known trade names are Mylar, Melinex and Hostaphan. An additional benefit of BoPET and related polyester films is that they are substantially non-water absorbing, so that their weight is not substantially increased when used around water and, when stowed under clamping member 430, they are less prone to mold and mildew growth, among other benefits.

In a further preferred embodiment, sail 425 is formed of Kevlar reinforced Mylar. Kevlar is the registered trademark for a para-aramid synthetic fiber, related to other aramids such as Nomex and Technora.

Sail 425 may be attached to shaft 402 through one or more attachment mechanisms. In one embodiment, the attachment mechanism is 2-sided tape. The tape is applied to the edge of sail 425 opposite clamping member 430. In this configuration, sail device 420 may be sold independent of a paddle and then attached (removing the cover from the other side of the 2-sided tape and attaching the tape to the shaft). Alternatively, the attachment mechanism may include that sail 425 is glued, melted onto, affixed with fasteners (screws, rivets, etc.) or otherwise attached to the shaft. The attachment may be fixed or removable.

Referring to FIG. 6, in the stowed position, sail device 420 may resemble the shaft 402. It's presence may be largely unnoticed, unless the shaft is more closely examined. Opening tab or protrusion 434 is shown (an slightly exaggerated in size to be distinguished in the figure), though depending on the position of clamping member 430 on shaft 402, may not be visible. Furthermore, tab 434 may be optional, or otherwise configured or placed.

Use of the paddle sail device 420 (and other embodiments) of the present invention is not restricted to the surfboard-like watercraft shown in the figures. Various other types of small personal watercraft (including those designed for a seated user) may be suitable for being propelled by the paddle and its attached sail.

In addition, the present invention is applicable to non-watercraft, such as wheeled terrestrial vehicles that may be propelled with a pole. For example, long board skateboards, or other wheeled terrestrial vehicles may be propelled with push-poles. Sail device 420 may be attached and used with the push pole shaft in a manner described above with paddle shaft 402.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A shaft mount sail device, comprising: a sail formed of a sheet of flexible material that is capable of being tightly wound about a shaft and has a first edge and a second edge; attachment mechanism provided along the first edge for affixing the sail to a shaft; and a longitudinally-disposed clamping member coupled to the second edge of the sail that is configured along the majority of member's length to releasably clamp onto a shaft, the clamping member is formed of a firm yet elastic material and defines a longitudinal opening, the clamping member being stretchable for the opening to fit over the diameter of a shaft, the elastic nature of the material then securely holding the clamping member to that shaft; wherein the sail device is configured such that when the attachment mechanism is affixed to a shaft and the sail is wound about that shaft, the clamping member, when fit over that shaft, securely holds the sail in this rolled, stowed position and serves as a handle by which a user grasps and operates a shaft to which the sail device is attached.

2. The sail device of claim 1, wherein the clamping member has a shape along the majority of the clamping member's length that is 51 to 100%, circumferentially, of a cylinder.

3. The sail device of claim 1, wherein the clamping member has a shape along the majority of the clamping member's length that is 55 to 85%, circumferentially, of a cylinder.

4. The sail device of claim 1, wherein the clamping member has a shape along the majority of the clamping member's length that is 60 to 80%, circumferentially, of a cylinder.

5. The sail device of claim 1, wherein the clamping member functions as a frame member supporting the majority of the second edge of the sail such that when the sail is exposed to a breeze the sail is supported along the second edge by the clamping member.

6. The sail device of claim 1, wherein the first edge and the second edge are substantially opposite one another, with the sail disposed between them.

7. The sail device of claim 1, wherein the sail is formed of a substantially non-water absorbing material.

8. The sail device of claim 1, wherein the sail is formed of a sheet of polyester based material.

9. The sail device of claim 1, wherein the sail includes a strength reinforcing fiber.

10. The sail device of claim 1, wherein the attachment mechanism comprises two-sided tape.

11. The sail device of claim 1, wherein the clamping member has a first opening edge and a protrusion extending off the first opening edge to assist in opening the first opening edge to mount or dismount the clamping member on or off a shaft.

12. A shaft mount sail device, comprising: a sail formed of a sheet of flexible substantially non-water absorbing material that is capable of being tightly wound about a shaft and has a first edge and a second edge, the second edge substantially opposite the first edge; attachment mechanism mounted to the first edge of the sail and configured from subsequent attachment to a shaft; and a longitudinally disposed clamping and frame member coupled to the second edge of the sail that has a shape along the majority of the member's length that is 51-100%, circumferentially, a cylinder and which is configured to releasably clamp onto a shaft, the clamping and frame member is formed of a firm yet elastic material and defines a longitudinal mount opening, the clamping and frame member being stretchable for the mount opening to fit over the diameter of a shaft, the elastic nature of the material then securely clamping the clamping and frame member to that shaft; wherein the sail device is configured such that when the attachment mechanism is affixed to a shaft and the sail wound about that shaft, the clamping and frame member, when fit over that shaft, securely holds the sail in this rolled, stowed position and serves as a handle by which a user grasps and operates the shaft.

13. The sail device of claim 12, wherein the clamping and frame member has a shape along the majority of the member's length that is 55 to 90%, circumferentially, of a cylinder.

14. The sail device of claim 12, wherein the clamping and frame member functions as a frame to support the majority of the second edge of the sail such that when the sail is exposed to a breeze the sail is supported along the second edge by the clamping and frame member.

15. The sail device of claim 12, wherein the sail is formed of a sheet of polyester based material.

16. The sail device of claim 12, wherein the sail includes a strength reinforcing fiber.

17. The sail device of claim 12, wherein the attachment mechanism comprises adhesive-based material.

18. The sail device of claim 12, wherein the clamping member has a first opening edge and a protrusion extending off the first opening edge to assist in biasing open the mount opening to mount or dismount the clamping member on or off a shaft.

19. A shaft mount sail device, comprising: a shaft used in manual propulsion of a transport device; a sail formed of a sheet of flexible material that is capable of being tightly wound about the shaft and has a first edge and a second edge;

attachment mechanism provided along the first edge for affixing the sail to the shaft;

and a longitudinally-disposed clamping and frame member coupled to the second edge of the sail that is configured along the majority of the member's length to releasably clamp onto the shaft, the clamping and frame member formed of a firm yet elastic material and defines a longitudinal opening, the clamping and frame member being stretchable for the opening to fit over the diameter of the shaft, the elastic nature of the material then securely holding the clamping member to the shaft;

wherein the sail device is configured such that when the sail is wound about that shaft, the clamping member, when fit over that shaft, securely holds the sail in this rolled, stowed position and serves as a handle by which a user grasps and operates the shaft.

20. The shaft mount sail device of claim 19, wherein the clamping and frame member has a shape along the majority of the member's length that is 51 to 100%, circumferentially, of a cylinder; wherein the clamping and frame member functions as a frame supporting the majority of the second edge of the sail such that when the sail is exposed to a breeze the sail is supported along the second edge by the clamping and frame member; and wherein the clamping and frame member has a first opening edge and a protrusion extending off the first opening edge to assist in biasing open the opening to mount or dismount the clamping member on or off the shaft.

* * * * *